US005982336A

United States Patent [19]

Wen et al.

[11] Patent Number: 5,982,336

[45] Date of Patent: Nov. 9, 1999

[54] STRUCTURE OF SUPER INTEGRATED DOWN CONVERTER (SIDC) WITH DUAL BAND MECHANICAL AND NOTCH FILTERS

[75] Inventors: Charles Wen; Feng-Ren Wang; Shun-Yu Chien, all of Hsinchu, Taiwan

[73] Assignee: Transystems, Inc., Hsinchu, Taiwan

[21] Appl. No.: 09/127,614

[22] Filed: Aug. 1, 1998

Related U.S. Application Data

[60] Provisional application No. 60/054,462, Aug. 1, 1997.

[51] Int. Cl.[6] ..... H01Q 9/16

[52] U.S. Cl. ..... 343/793; 343/795; 343/840; 333/134

[58] Field of Search ..... 343/793, 795, 343/756, 840, 909, 700 MS, 820, 821, 822; 333/126, 134; 455/293, 333; H01Q 9/16

[56] References Cited

U.S. PATENT DOCUMENTS 5,402,138 3/1995 Hulett et al. ..... 343/840
5,523,768 6/1996 Hemmie et al. ..... 343/840
5,898,411 4/1999 Mcgaffigan et al. ..... 343/801

*Primary Examiner*—Don Wong
*Assistant Examiner*—Tho Phan
*Attorney, Agent, or Firm*—Bo-In Lin

[57] ABSTRACT

The present invention discloses an integrated dipole antenna and down converter apparatus. The integrated dipole antenna and down converter apparatus includes a dipole antenna for receiving microwave signals therein. The integrated dipole antenna and down converter apparatus further includes a down converter for receiving processed signals of the microwave signals from the dipole antenna for converting the processed signals to signals of lower frequency. The down converter includes main plate for supporting a tunable notch mechanical. The down converter further includes a tunable dual band mechanical filter supported on the plate. The dual band mechanical filter and notch mechanical filter both include capacitance adjusting means adjustable by applying a mechanical screwing method whereby signal filtering efficiency is improved by reducing signal dissipation and the performance of the down converter is improved with the mechanically adjustable dual band and notch mechanical filters.

1 Claim, 9 Drawing Sheets

STRUCTURE OF SUPER INTEGRATED DOWN CONVERTER (SIDC) WITH DUAL BAND MECHANICAL AND NOTCH FILTERS

This Formal Patent Application claims a priority date of Aug. 1, 1997 based on a Provisional Application Ser. No. 60/054,462 filed on Aug. 1, 1997 by the same Applicants.

BACKGROUND OF THE INVENTION

1. Field of the Invention

This invention relates generally to the apparatus and method of a down converter for microwave signal reception. More particularly, this invention relates to a new and improved structure and a method of manufacture for an integrated down converter with a dipole antenna formed as a single-body assembly using a dual band mechanical filter and a notch filter. The integrated down converter and dipole antenna is employed in a television signal antenna-reflector system to improve the reliability and filtering performance in receiving and processing the television signals.

2. Description of the Prior Art

For television signal reception, several technical difficulties exist in using a conventional down converter for typical semi-parabolic or dish-shaped antennas. The design involves a feed antenna integrated with a down converter. The down converter which is integrated with a dipole antenna and implemented as part of the semi-parabolic antenna as a single operation unit is commonly installed on a roof top to operate in an outdoor environment. In order to insulate the dipole antenna and the down converter from water damages, special packaging material such as certain plastic container and fillers injected into a housing structure are required. The difficulties arise from the fact that the performance characteristics of the dipole antenna are often altered significantly during the filler injection process depending on various filler injection parameters. While the functional relationship between the performance characteristics and the parameters applied in the filler injection process are difficult to measure and control, a dipole antenna has to be designed and manufactured through several trial-and-error iterations. These iterations have to be carried out before a dipole antenna can achieve precise performance characteristics when packaged with plastic injection can be completed. Thus, the dipole antenna implemented with the plastic injection molding package are generally considered as inconvenient and expensive due to the requirement of applying this trial-and-error iterative manufacture process. In addition to the technical difficulties faced by those involved in manufacturing the dipole antenna, a mechanical filter implemented for down converter is not commonly used despite its excellent filtering performance. Similar to that of the dipole antenna, a fine-tuning of the filtering characteristics of a mechanical filter is often difficult to carry out with high precision as part of the manufacture processes. Like the dipole antenna packaged with plastic molding, a mechanical filter implemented for a down converter is also considered as expansive and inconvenient due to these difficulties.

Other than this high quality mechanical filter configuration, a down converter for semi-parabolic shaped antenna can also be manufactured on a printed circuit board (PCB), e.g., a FR4 PC board. One example of such a structure for build a down converter is disclosed in a U.S. Pat. No. 5,523,768, entitled "Integrated Feed and Down Converter Apparatus" by Hemmie et al. (issued on Jun. 4, 1996). An integrated semi-parabolic antenna/down converter multi-channel multi-point distribution system (MMDS) receiver is disclosed by Hemmie et al. which includes a support boom of a semi-parabolic antenna to contain the down converter electronics. Located at the focal area of the semi-parabolic antenna are a pair of driven feed elements which are directly connected to the printed circuit board carrying the down converter electronics. The down converter is formed in an elongated shape to fit entirely within the formed hollow interior of the support boom. The down converter comprises a first printed circuit board, which contains an RF filter located at the input end of the printed circuit board. The input to the RF filter circuit is directly connected to the pair of driven feed elements by soldering the legs of the driven feed elements directly to the input of the RF filter stage on the first printed circuit board. The RF filter is surrounded by an input ground shield, which covers the RF filter circuit. The shield is soldered to the top and bottom ground planes of the printed circuit board. At the opposite end of the printed circuit board is an output amplifier whose output is connected to a coax output lead. A coax ground shield engages the opposite end of the first printed circuit board in a perpendicular orientation so as to position the opposite and of the printed circuit board with the hollow interior.

While the printed circuit board (PCB) filters can be manufactured with simplified and automated procedures. Thus, the PCB filters provide the benefit of low cost implementation in the down converter. However, the PCB filters suffer from the disadvantages that energy transmission through the filters are impeded due to high dissipation over the PCB where large percents of signal energy are stored instead of transmitted through. The performance of signal filtering is also affected by temperature variations due to the fact that signal energy dissipation depends on the environmental temperature around the PCB. For these reasons, a PCB filter is not suitable for generating signals to be further processed by a low noise amplifier. A different type of filter is manufactured by forming the filter on a ceramic substrate. Such a filter also suffers the same disadvantages as a PCB filter due to the fact that significant signal energy dissipation also incurs in the ceramic substrate. Again, the ceramic type of filters is not suitable for generating signals to be amplified by a low noise amplifier.

For the structure and manufacture techniques of the dipole antenna, due to the difficulties faced by the process of plastic injection molding, printed circuits formed on a FR4 type of printed circuit board (PCB) are also being employed. It has the advantages that the PCB types of dipole antennas are easy and more convenient to design and manufacture. However, the PCB type of dipole antennas are less reliable for the purpose of leakage prevention and structurally much more vulnerable to different kinds of outdoor weather conditions. Also, a two-dimensional shape of the antenna limits the bandwidth of a PCB dipole antenna when the printed circuits on a board are employed. Other than the PCB type of dipole antenna, employing a cable-cooper composite material to form the dipole antenna also provides an alternate structure. However, this type of antennas are commonly formed as a flat-board dipole antenna according to the performance characteristics of the cable-copper cooper material which also are subject to a bandwidth which is often quite limited for intended signal reception applications.

Therefore, a need still exists in the art of down converter for television signal reception to provide a new structure and manufacture method to produce a new type of dipole antenna and down converter. This new type of dipole antenna is to achieve the purpose that high quality low-cost dipole antenna integrated with a down converter for carrying out reception and frequency conversion of the television can be provided. It is desirable that a novel structure of a signal filter can be employed to provide the performance level of a mechanical filter in a down converter without requiring time consuming design and development efforts such that the manufacture cost of the down converter can be reduced. It is further desirable that the dipole antenna when integrated with a down converter can provide high structural integrity suitable for reliable long-term outdoor operation.

SUMMARY OF THE PRESENT INVENTION

It is therefore an object of the present invention to provide a novel down converter structure and signal processing configuration combining a dual band mechanical filter and a notch. The performance characteristics of the down converter can be conveniently controlled in the manufacturing processes whereby the aforementioned difficulties and limitations in the prior art can be overcome.

Specifically, it is an object of the present invention to provide a novel down converter structure and signal processing configuration combining a dual band mechanical and a notch filter. The adjustment of the filtering characteristics of the mechanical filter and the notch filter can be conveniently readjusted whereby a time consuming process in applying an iterative trial-and-error manufacture procedure for tuning the performance characteristics of the mechanical and notch filters can be circumvented.

Another object of the present invention is to provide a novel down converter structure and signal processing configuration combining a dual band mechanical and a notch filter. A simplified housing assembly is provided to contain the dual band mechanical filter and the notch filter integrated with the dipole antenna as a single-body assembly with seamless body composed of casting aluminum sealed with a single leak proof lid. Total waterproof of the dipole antenna-down converter is assured to provide reliable long term outdoor operation.

Another object of the present invention is to provide a novel down converter structure and signal processing configuration combining a dual band mechanical and a notch filter by integrating the down converter with an improved dipole antenna and a balance-unbalance converter. The dipole antenna is manufactured with higher water resistivity and structural integrity while providing high bandwidth performance characteristics between a bandwidth ranging from 2 GHz to 3 GHz.

Another object of the present invention is to provide a novel down converter structure and signal processing configuration combining a dual band mechanical and a notch filter. A low signal dissipation is achieved and high stability of signal conversion is continuously performed such that a down converter of high efficiency and high stability manufactured with simplified procedures at lower cost than conventional down converter with mechanical filter is provided.

Another object of the present invention is to provide a novel dipole antenna structure for integration with a down converter. The dipole antenna is formed with special aluminum alloy covered by injection plastic molding to form a strong and reliable structure while provide broad bandwidth performance and convenient and seamless integration with the down-converter.

Briefly, in a preferred embodiment, the present invention includes integrated dipole antenna and down converter apparatus. The integrated dipole antenna and down converter apparatus includes a dipole antenna for receiving microwave signals therein. The integrated dipole antenna and down converter apparatus further includes a down converter for receiving processed signals of the microwave signals from the dipole antenna for converting the processed signals to signals of lower frequency. The down converter includes main plate for supporting a tunable notch mechanical filter. The down converter further includes a tunable dual band mechanical filter supported on the plate. The dual band mechanical filter and notch mechanical filter both include capacitance adjusting means adjustable by turning the adjusting screws for changing the distance between the mechanical filtering element and the supporting main plate thus fine tuning the capacitance therein. The signal filtering efficiency is improved by dissipation and the performance of the down converter is improved with the mechanically adjustable dual band and notch mechanical filters.

These and other objects and advantages of the present invention will no doubt become obvious to those of ordinary skill in the art after having read the following detailed description of the preferred embodiment which is illustrated in the various drawing figures.

DETAILED DESCRIPTION OF THE PREFERRED EMBODIMENT

Figure 1:
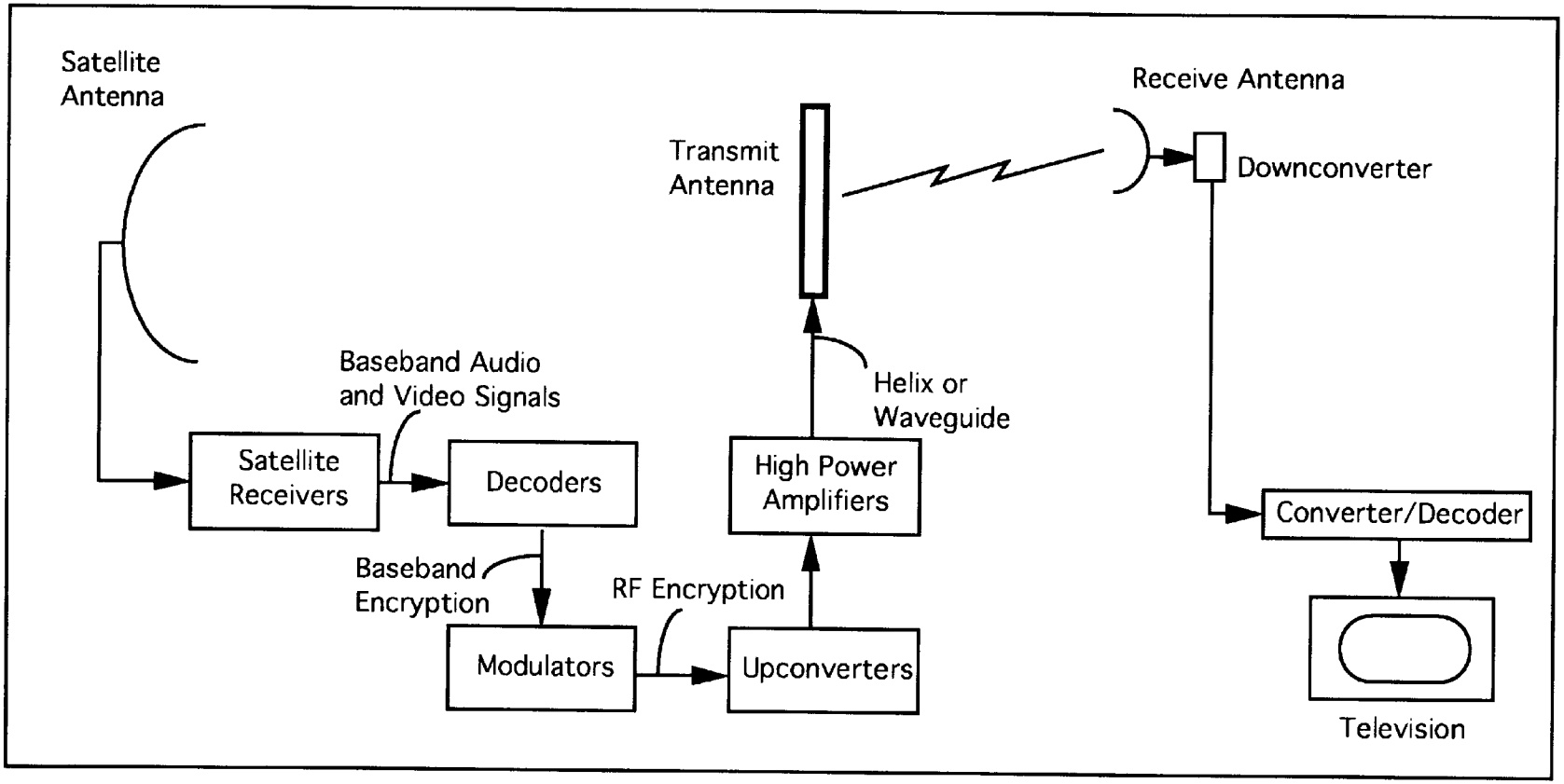
FIG. 1 (Prior Art)
FIG. 1 is a functional diagram to illustrate the functions performed by various systems employed for television signal transmission including the integrated antenna-down converter system pertinent to this invention.
Figure 2A:
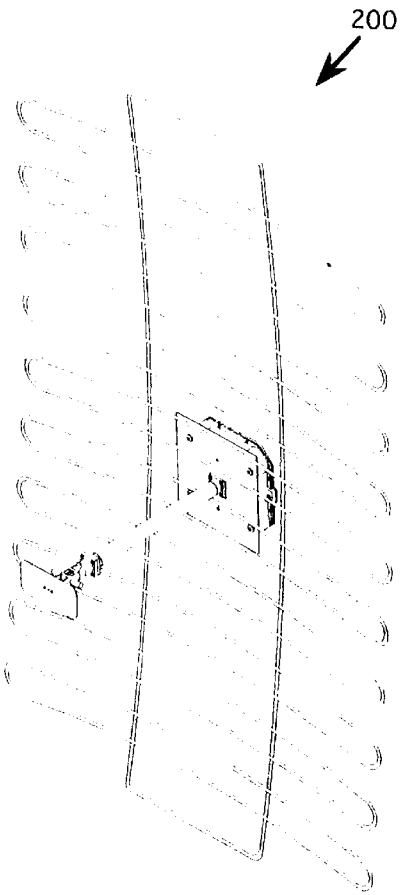
FIGS. 2A to 2C are a perspective view for showing the mounting mechanism and structural features of a novel down converter of the present invention mounted onto an antenna reflector for operation as a single body system.
Figure 2B:
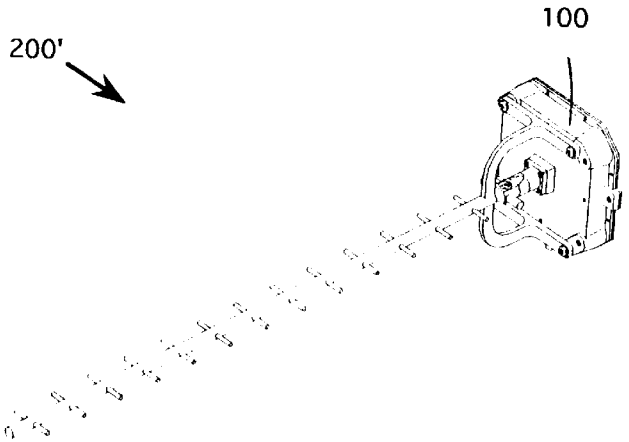
Figure 2C:
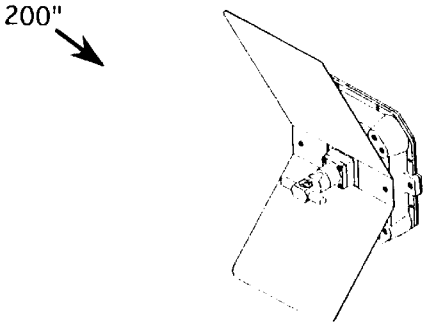
Figure 3:
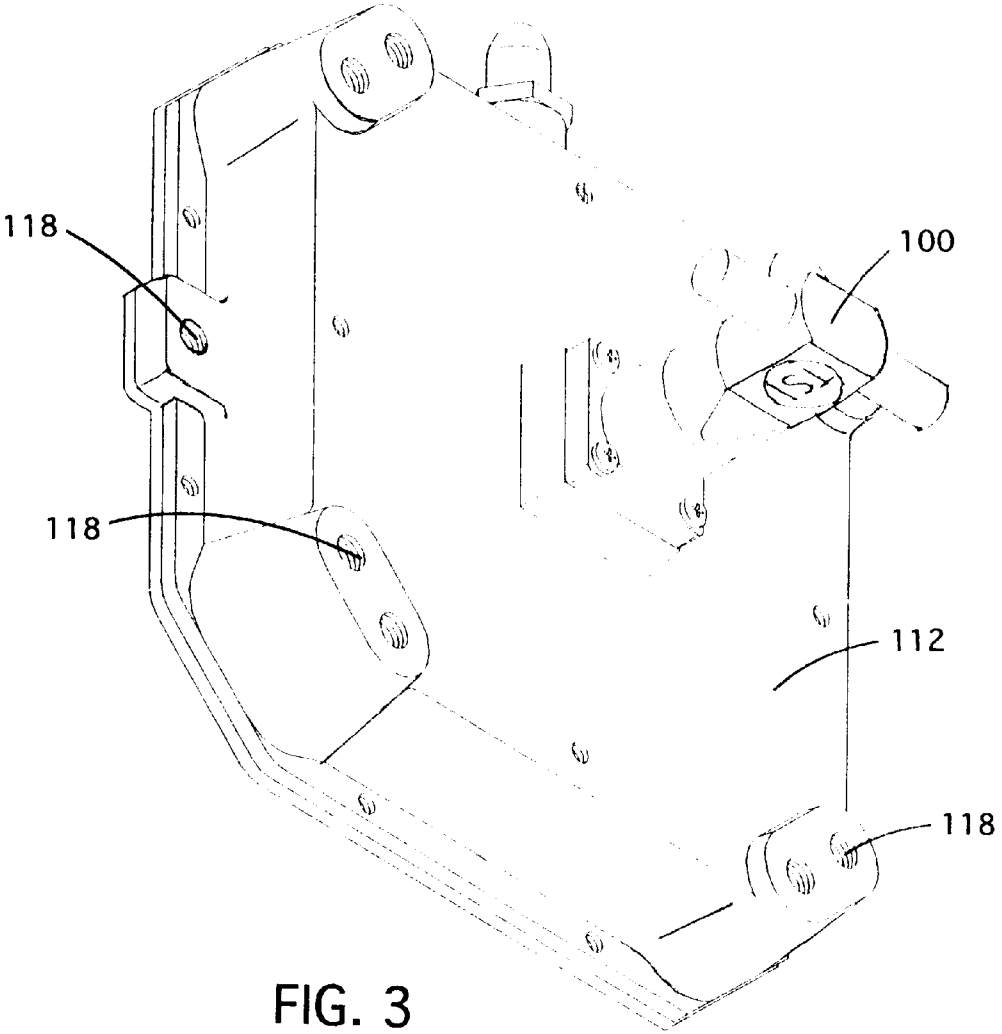
FIG. 3 shows a seamless housing structure of the down converter of this invention integrated with a dipole antenna mounted thereon as a top cover unit.

Referring to FIGS. 1 and 2A to 2C for an overall perspective view showing the sequence of signal transmission and process flow (FIG. 1), and the structural features of a novel integrated down converter-dipole antenna unit 100 of this invention. It is implemented in an antenna reflector system 200 (FIG. 2A), with an YAGI antenna 200' (FIG. 2B) and a corner reflector 200" (FIG. 2C). The integrated down converter-dipole antenna unit 100 is placed at a central focal area of these reflector antenna systems and mounted securely thereto with mounting brackets. Referring to FIG. 3 for a perspective view of the dipole antenna for the integrated down converter-dipole antenna unit 100 which includes a dipole antenna 110, mounted onto a cover 112 for covering and attaching to housing body containing a down converter 120 (see FIG. 6A). The cover 112 includes threaded holes 118 for securely sealing and attaching to a housing assembly of the integrated down converter-dipole antenna unit 100.

Figure 4:
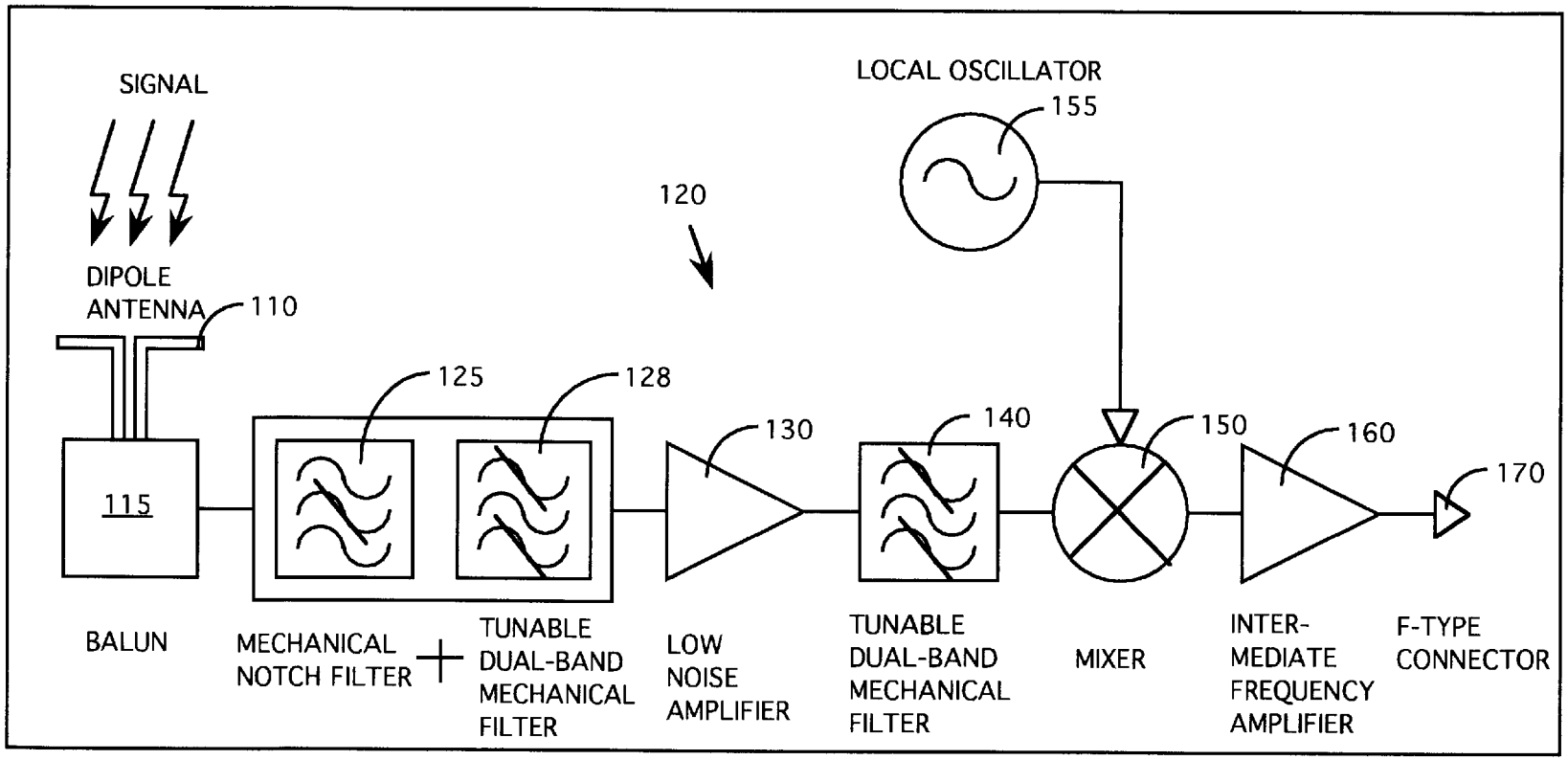
FIG. 4 is a functional block diagram for showing the flow of signal processing steps carried out by different components included in the down converter of the present invention.

Referring to FIG. 4 for a functional block diagram for illustrating different components included in the down converter 120. The television signal is first received by the dipole antenna 110 as balanced signals and transmitted to a balance-to-unbalance (BALUN) converter 115 to convert to an unbalanced signal. The unbalanced signals generated from the BALUN converter 115 are processed by a dual band notch mechanical filter 125 wherein only signals of particular bandwidths suitable for television display are filtered through the dual band notch filters 125. The output signal generated by the dual band notch mechanical filter 125 are then processed by a dual band mechanical filter 128 to filter out the interfering radar signals before such signals are amplified by a low noise amplifier 130. The amplified signals are then processed by a second-stage dual band mechanical filter 140 to assure the unnecessary signals are filtered out such that the circuit elements at the later stages would not be damaged by random signals incidentally passing through. The filtered signal generated from the semi-mechanical filter 140 are entering into a mixer 150 for mixing with a high-precision high frequency signal generated from a local oscillator 155 where a frequency differential signal is generated for converting the high frequency to a UHF or VHF bandwidth. A phase lock loop is employed in the local oscillator 155 for generating a high precision high frequency signal. The UHF or VHF signals are processed by an intermediate frequency amplifier 160 and outputted from a F-type connector 170.

Figure 5A:
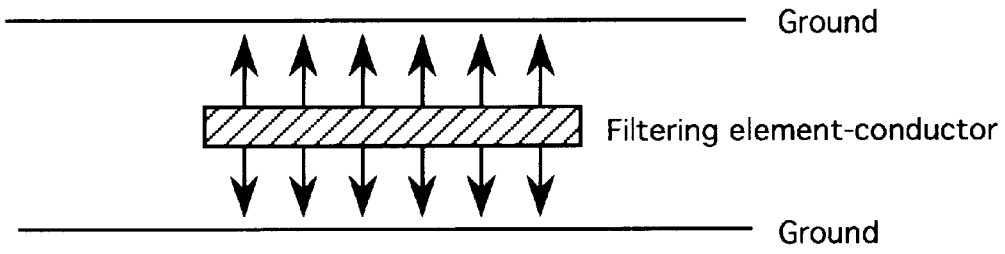
FIGS. 5A to 5C are a functional diagrams for illustrating the working principles of the dual band mechanical filter and the mechanical notch filter according to the novel structure of this invention.

FIG. 5A is a functional diagram to illustrate the working principle of the dual-band mechanical filters 128 and 140 implemented in the down converter 120. The mechanical filters 128 and 140 are structured by placing the filtering element generally composed of a conductive material in the center between two ground voltages. As will be shown in FIG. 6B, the dual band mechanical filter is placed between a main plate and the down converter cover. By arranging a symmetrical electrical field between the upper and lower gaps between the filtering element and the housing container which is provided with a ground voltage. The energy of the signals would then be stored in the air of the upper and the lower gaps because of the symmetrical arrangement. Instead of dissipating through the PC board as that occurred in a conventional down converter, the dual band mechanical filters 128 and 140 provide a high frequency filter which has a low signal dissipation characteristic of a mechanical filter while the structure is very simple. With further details illustrated in FIG. 6B below, simple and convenient manufacture processes can be applied to assemble the dual-band mechanical filter 128 and 140. A high frequency mechanical filter of high stability and low cost is therefore disclosed in this invention.

Figure 5B:
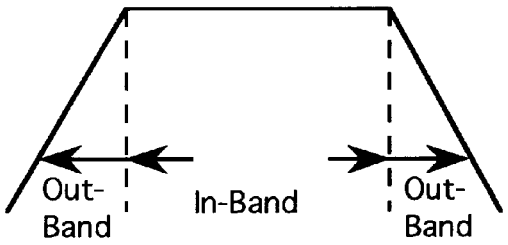
Figure 5C:
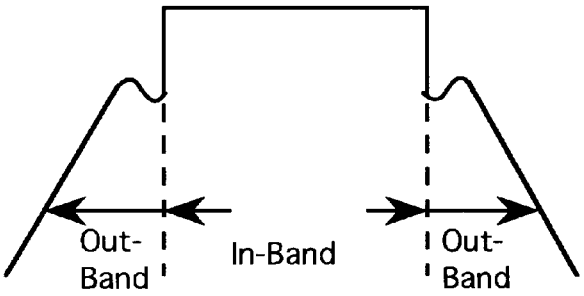

FIGS. 5B and 5C shows the working principles of the notch mechanical filter 125. For an UHF band application, an inductor-capacitor circuit element is employed as that shown in FIG. 5B to filter out the resonance frequency of the L-C circuit. Thus by adjusting the inductance and the capacitance, the Q-value of the filter can be optimized to form a band stop filter of a very narrow bandwidth at a pre-designated resonance frequency. In the radio frequency (RF) range, especially for frequency higher than 1.5 GHz, due to the difficulties caused by greater energy dissipation in signal transmission over various types of materials, application of a notch filter has become much less favorable due to the very poor Q-value. For this reason, notch filter is commonly not employed for high frequency applications. The present invention take advantage of a special filter performance characteristics that for a mechanical band pass filter there is a very high impedance for the signals with frequencies in an out-band rang as that shown in FIG. 5C. Therefore, by employing a notch filter with resonance frequency right in the range of the out-band frequency of the mechanical band pass filter would produce great improvement of performance. Therefore, the notch mechanical filter 125 is included to filter out a particularly designate frequency within the rang of out-band frequency as shown by applying the resonance of an inductor-capacitor structure provided in this invention. The inductor-capacitor structure, as will be further describe below, is formed by employing a mechanical filter structure whereby the performance of this mechanical notch filter is suitable for high frequency RF applications. The noise generated by interference from ground reflection of radar signals between 2500 to 2886 MHz are filtered out as shown in FIG. 5C by the use of this high quality mechanical notch filter 125.

Figure 6B:
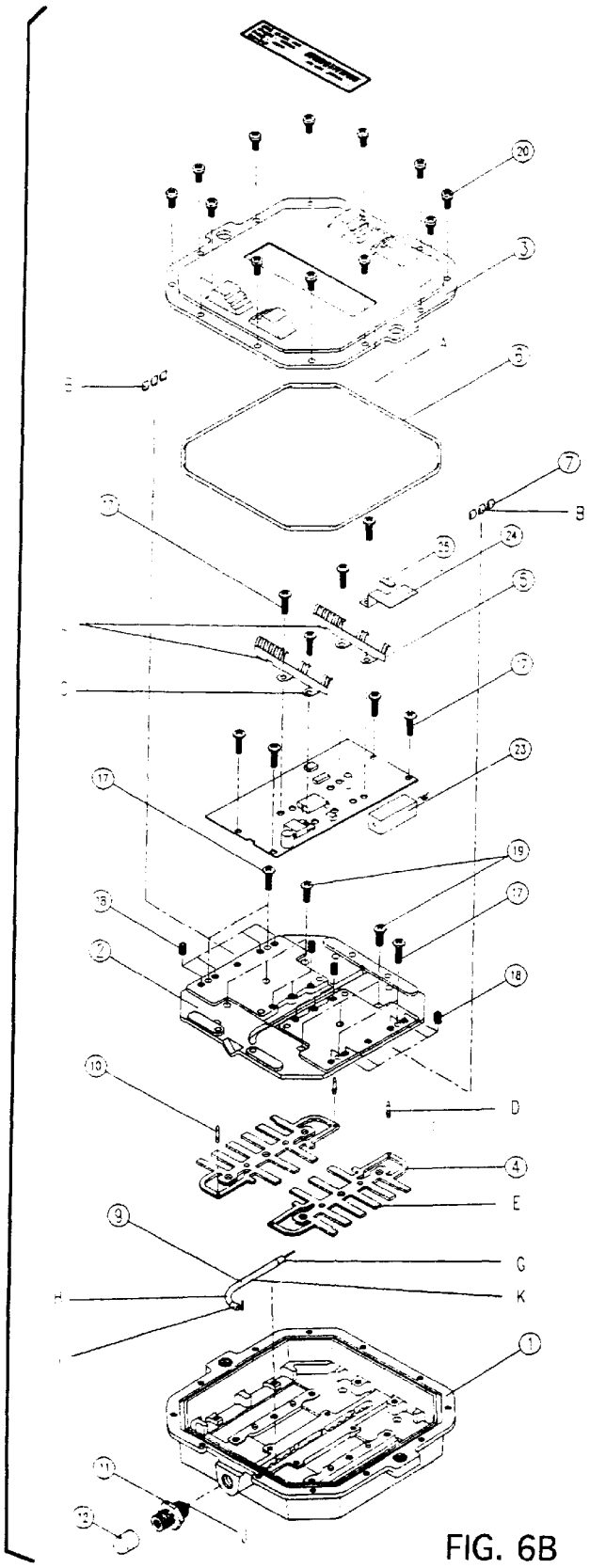
FIGS. 6A to 6C are an explosive perspective views of the dipole antenna and integrated down converter to show the seamless structure of the housing for containing and protecting the down converter and the leak proof lid integrated with the dipole antenna mounted thereon.
Figure 6A:
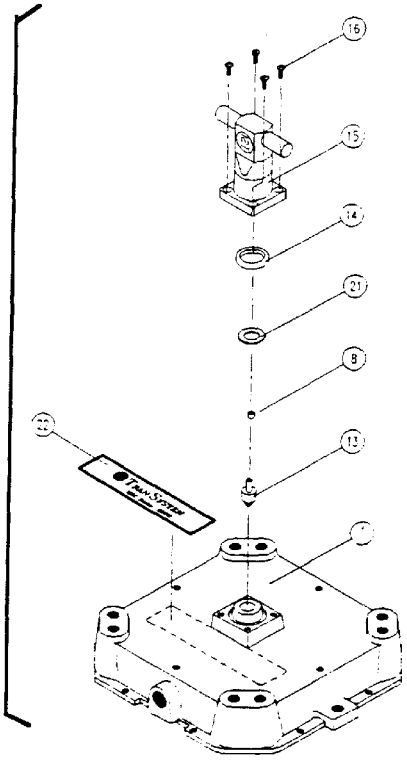
Figure 6C:
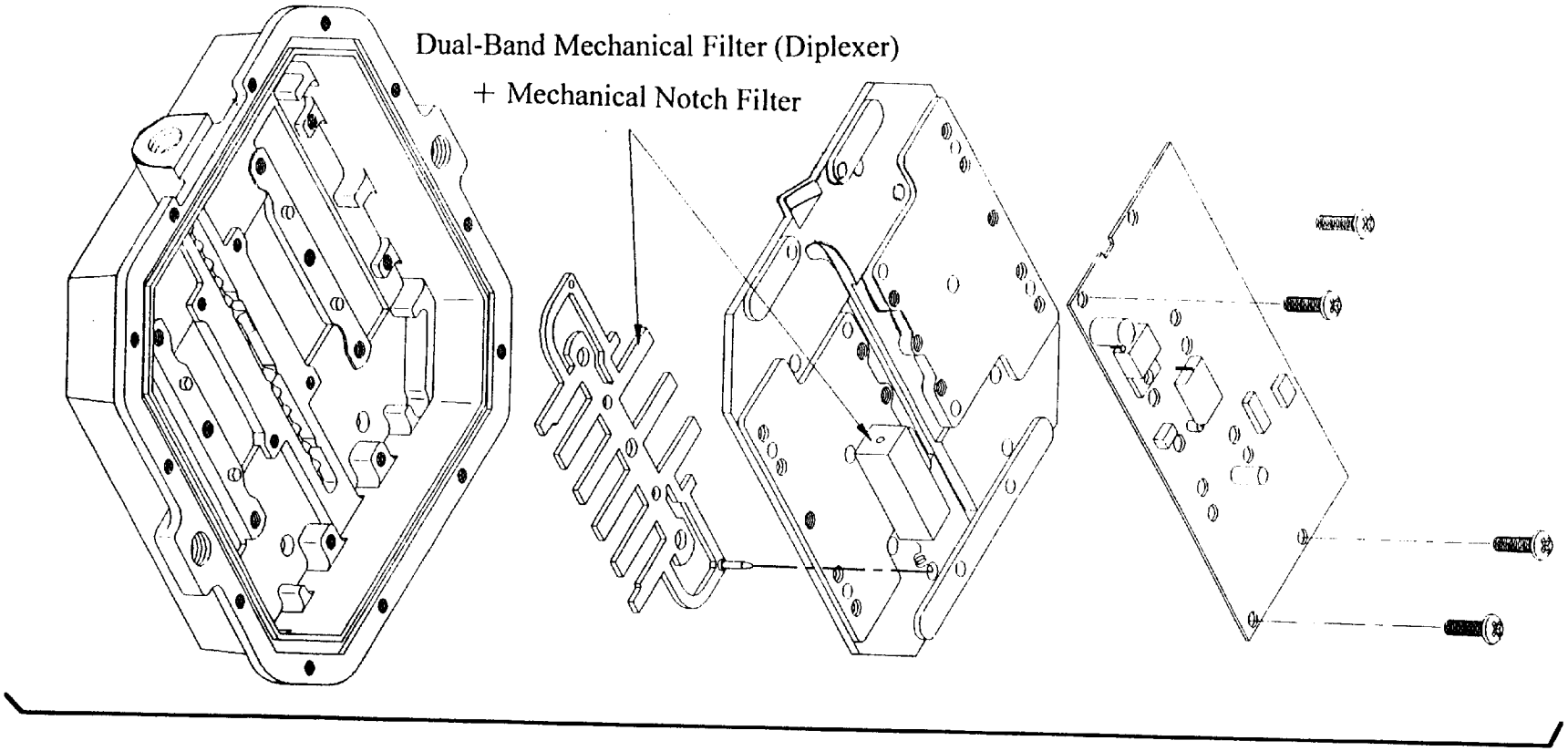

FIGS. 6A to 6C are explosive views to show the detail structure of the down converter 120 and the structural features of the dipole antenna. The down converter 120 is contained in a seamless housing 301. The down converter 120 is structured with a main plate 302, which receives incoming signals from a dipole antenna 110 via an N-con pin 309 and conductive rubber 307. The dipole antenna 110 is securely attached to the seamless housing 301 via four screws via an O-ring 306. A mechanical notch filter 125 includes a notch block conductor 323 and a notch inductor 322 disposed under a conductor cover 303 and clamped to a main plate 302 by a notch clamp 324 via a notch rubber 325. The notch block conductor 323 and notch inductor 322 form a serial L-C notch filter to remove interference at a certain bandwidth by employing the resonance provided by the mechanical L-C circuit wherein the capacitance and the inductance can be mechanically adjusted. The down converter 120 further include a first and a second dual band mechanical filters 304. A pair of springs 306 is employed to flexibly adjust the distances between the dual band mechanical filter 128 and 140 main board 302 with several flexible screws 318 made of nylon. These flexible screws 318 provide a spring cushion to the main board 302 for a pair of springs 307 to adjust the distance between the filtering conductor 304 and the top surface of the main plate 302. The filtering characteristics of the notch mechanical filter 125 are a function of the capacitance formed between the conductor 304 and the top surface of the main plate 302. And the capacitance C can be calculated by:

$$C=(\in A)/d \tag{1}$$

where $\in$ is the dielectric coefficient of the of the air or a dielectric material placed between the filtering conductor 304 and-the main plate 302. Where "A" represents the area of the filtering conductor 304 and d is the distance between the filtering conductor 304 and the bottom surface of the main plate 302. Therefore, by adjusting the screws, the distance d is changed, consequently the capacitance C is changed and the filtering characteristics of the notch mechanical filter 125 is tuned.

A terminal capacitance is formed between the end face of those tuning screws 318 and the arm of the conductor body 304. Therefore, by adjusting the screw, the distance between the screw 318 and the conductor body 304 is changed, consequently, the capacitance is changed and the filtering characteristics of the mechanical filters 128 and 140 are tuned.

After the mechanical filters 125 and 128 with structures described above filter the incoming signals, a low noise amplifier 130 is applied to amplify the filtered signals. The circuit details of the low noise amplifier 130 are well known in the art and not shown. As depicted in FIG. 6, these circuits are formed on the top assembly, e.g., a printed circuit board 305 with a mechanical filter 140 to further filter undesirable interference, the quality of the signal reception is further improved. The use of an O-ring 308 is to provide a reliable waterproof environment for the down converter 120.

According to FIG. 6 and above descriptions, the present invention discloses an integrated dipole antenna and down converter apparatus 100. The integrated dipole antenna and down converter apparatus 100 includes a dipole antenna 110 for receiving microwave signals therein. The integrated dipole antenna and down converter apparatus further includes a down converter 120 for receiving processed signals of the microwave signals from the dipole antenna 110 for converting the processed signals to signals of lower frequency. The down converter includes main plate 302 for supporting a tunable notch mechanical filter 125. The down converter further includes a tunable dual band mechanical filter 140 supported on the plate 302. The dual band mechanical filter 140 includes an upper circuit assembly and a lower circuit assembly for providing ground voltages and to provide space for electromagnetic waves transmitting in the gaps between the filter and the upper and lower circuit assemblies. The signal filtering efficiency is improved by reducing signal dissipation in the upper and lower circuit assemblies. In a preferred embodiment, the integrated dipole antenna and down converter apparatus 100 further includes housing 301 for containing the down converter 120. The housing 302 and the upper and lower circuit assemblies and defining an upper and a lower space for storing energy of the electromagnetic waves therein thus reducing signal dissipation in the upper and lower circuit assemblies.

Figure 7A:
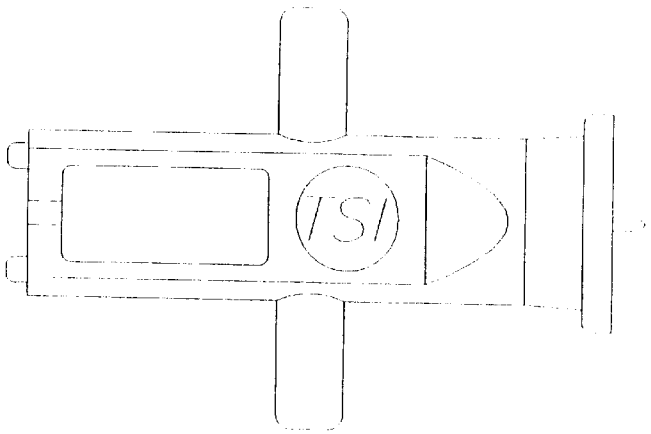
FIGS. 7A to 7C are two cross sectional views showing the relative position and the structure of the improved dipole antenna of the present invention.
Figure 7B:
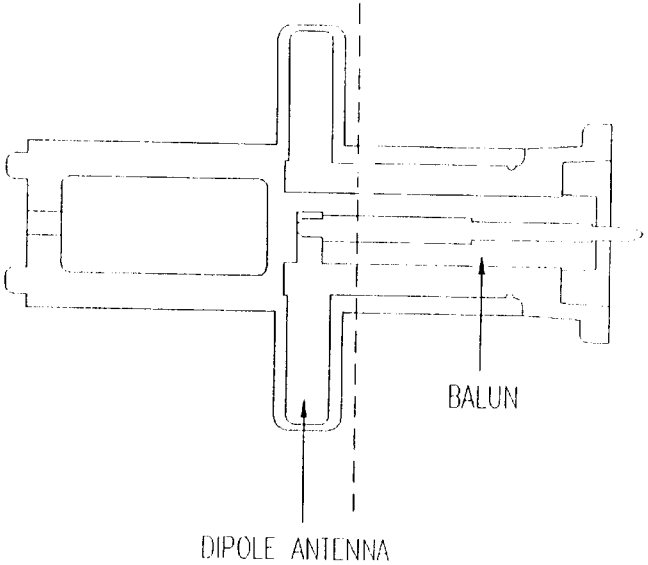
Figure 7C:
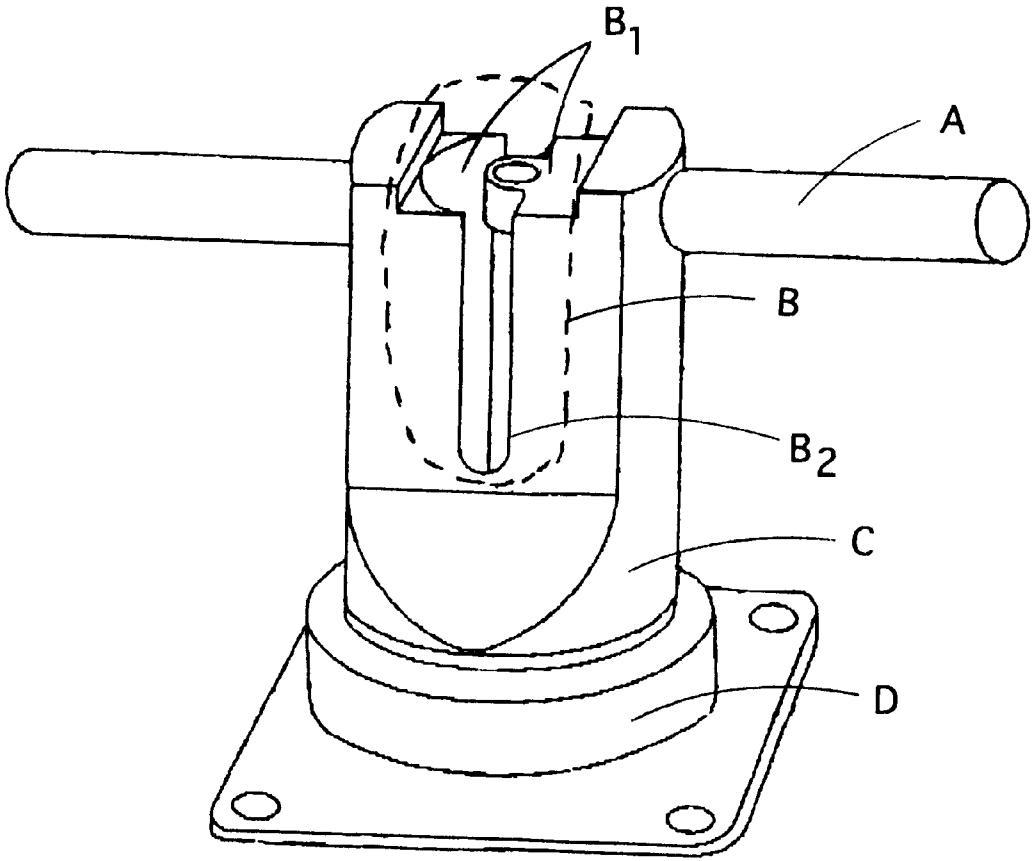

Referring to FIGS. 7A to 7C for three cross sectional views of the dipole antenna 110. The dipole antenna receives the electromagnetic waves. The signals received are balanced signals. The balanced signal is processed by a balance-unbalance (BALUN) converter to converter the balanced signal into unbalanced signals. In a preferred embodiment, the dipole antenna is a half wave-length dipole antenna. It includes a radiator, a BALUN as described above, a transformer and an output connector and these four major parts are integrated as a unit-body structure wherein the connector is a N-type connector to provide convenience for signal testing. The integrated unit-body assembly comprising the four major parts as discussed above are manufactured by use of an aluminum alloy to provide excellent signal reception and transmission characteristics. The radiator is a cylindrical shape wherein the length is slightly shorter than a half-wave-length and the diameter is about 0.043 wavelength. Because the diameter is significantly greater than a regular thin dipole antenna where the diameter is 0.0001 wavelength, this dipole antenna is structurally much stronger and reliable. The BALUN is structured with an open slot configuration (shown as B in FIG. 7C). The structure is simple and yet providing wide bandwidth sensitivity. The open slot structure is configured such that the contact between the inner portions of the radiator A to the inner conductive plate of the open slot (shown as B1 in FIG. 7C), and the distance to the outer conductive plate of the open slot (shown as B2 in FIG. 7C) are substantially identical. The electromagnetic wave can be distributed evenly and uniformly. The bottom corner of the open slot structure of the BALUN are manufactured with round shape which further improve the production yield and the transmission stability of the electromagnetic wave. The impedance transformer is a quarter wave transformer, which can be configured by changing the diameter of the inner conductive plate of the open slot structure (shown as C in FIG. 7C). The output connector, shown as D in FIG. 7C, is made of materials suitable for outdoor operation. Also materials which has less energy dissipation, e.g., plastic of e=2.5, is used. Also, this material is used for performing a plastic injection molding to protect and insulate the BALUN and transformer. This plastic cover also provides a special function to serve as a fixture for the parabolic reflect to perform a secondary reflection. Thus the dipole antenna can be installed with greater degree of flexibility. As the injection molding is performed with high precision, the performance characteristics of the dipole antenna, according to above configuration can be controlled to achieve specific signal reception requirements. The integration of the antenna radiator, BALUN, the impedance transformer and the output connector as a unit body assembly through an injection molding operation is a novel manufacture process and a new structural configuration to provide reliable and broad bandwidth performance.

Although the present invention has been described in terms of the presently preferred embodiment, it is to be understood that such disclosure is not to be interpreted as limiting. Various alternations and modifications will no doubt become apparent to those skilled in the art after reading the above disclosure. Accordingly, it is intended that the appended claims be interpreted as covering all alternations and modifications as fall within the true spirit and scope of the invention.

We claim:

1. An integrated antenna and down converter apparatus comprising:

a dipole antenna for receiving microwave signals therein;

a down converter for receiving processed signals of said microwave signals from said dipole antenna for converting said processed signals to signals of lower frequency wherein said down converter includes a main plate for supporting a tunable notch mechanical filter; and said down converter further includes a tunable dual band mechanical filter supported on said main plate wherein said dual band mechanical filter and said notch mechanical filter both include capacitance adjusting means adjustable by turning a plurality of adjusting screws for changing a distance between a mechanical filtering element and said supporting main plate for fine tuning said capacitance.

* * * * *